US011802327B1

(12) United States Patent
De et al.

(10) Patent No.: US 11,802,327 B1
(45) Date of Patent: Oct. 31, 2023

(54) ULTRA-HIGH STRENGTH HOT-ROLLED STEEL WITH TOUGHNESS AND METHOD OF MAKING SAME

(71) Applicant: Big River Steel, LLC, Osceola, AR (US)

(72) Inventors: Amar K De, Cordova, TN (US); Denis Hennessy, Marion, AR (US); Chirag R. Mahimkar, Memphis, TN (US)

(73) Assignee: Big River Steel, LLC, Osceola, AR (US)

( * ) Notice: Subject to any disclaimer, the term of this patent is extended or adjusted under 35 U.S.C. 154(b) by 124 days.

(21) Appl. No.: 17/062,078

(22) Filed: Oct. 2, 2020

(51) Int. Cl.

| | |
|---|---|
| ***C22C 38/28*** | (2006.01) |
| ***B21B 3/02*** | (2006.01) |
| ***C22C 38/26*** | (2006.01) |
| ***C22C 38/04*** | (2006.01) |
| ***B22D 11/00*** | (2006.01) |
| ***C22C 38/06*** | (2006.01) |
| ***C21D 8/02*** | (2006.01) |
| *C21D 6/00* | (2006.01) |

(52) U.S. Cl.
CPC ..... *C22C 38/28* (2013.01); *B21B 3/02* (2013.01); *B22D 11/001* (2013.01); *C21D 8/0226* (2013.01); *C22C 38/04* (2013.01); *C22C 38/06* (2013.01); *C22C 38/26* (2013.01); *C21D 6/002* (2013.01); *C21D 6/005* (2013.01)

(58) Field of Classification Search
CPC ..... C22C 38/28; B21B 3/02; B22D 11/001; C21D 8/0226; C22C 38/04; C22C 38/06; C22C 38/26; C21D 6/002; C21D 6/005

See application file for complete search history.

(56) References Cited

U.S. PATENT DOCUMENTS

2016/0237515 A1* 8/2016 Kajihara et al. ..... C22C 38/001
2020/0255917 A1* 8/2020 Zhang et al. ..... C22C 38/004

OTHER PUBLICATIONS

Aging Behaviour in Copper Bearing High Strength Low Alloy Steels, Bhagat, A., ISIJ International, Vol. 44, No. 1, pp. 115-22 (2004).
Development of High Strength Hot-rolled Sheet Steel Consisting of Ferrite and Nanometer-sized Carbides, Funakawa, Yoshimasa, ISIJ International, Vol. 44, No. 11, pp. 1945-51 (2004).
Development of Steel Plates by Intensive Use of TMCP and Direct Quenching Processes, Ouchi, Chiaki, ISIJ International, Vol. 41, No. 6, pp. 542-53 (2001).
Effect of Nb on Hot Rolled High Strength Steel Sheets Produced by Thin Slab Casting and Hot Direct Rolling Process, Hashimoto, Shunichi, ISIJ International, Vol. 43, No. 10, pp. 1658-1663 (2003).
Effect of Thermomechanical Processing on the Microstructure and Properties of a Low Carbon Copper Bearing Steel, Banerjee, M., ISIJ International, Vol. 41, No. 3, pp. 257-61 (2001).
Multi-phase Microstructures and Their Properties in High Strength Low Carbon Steels, De Ardo, Anthony, ISIJ international, Vol. 35, No. 8, pp. 946-54 (1995).

* cited by examiner

*Primary Examiner* — Anthony M Liang
*Assistant Examiner* — Danny N Kang
(74) *Attorney, Agent, or Firm* — SIMONELLI IP, PLLC

(57) ABSTRACT

A method is used to fabricate a hot-rolled steel having a yield strength greater than 550 MPa and an impact toughness of at least 27 J at a temperature of -40° F. In one embodiment, the yield strength is greater than 690 MPa. The method includes melting steel to create melted steel. The melted steel is poured into a mold. The metal steel is continuously cast into a steel slab. The steel slab is heated to maintain a predetermined temperature. The steel slab is rolled to reduce the thickness to a predetermined thickness to create a hot-rolled steel sheet.

1 Claim, 3 Drawing Sheets

ULTRA-HIGH STRENGTH HOT-ROLLED STEEL WITH TOUGHNESS AND METHOD OF MAKING SAME

BACKGROUND ART

Field of the Invention

The invention is related to high strength, high impact toughness steels. More particularly, the invention relates to ultra-high strength, high impact toughness steels and a method of fabricating same.

Description of the Related Art

Steels are formulated to provide specific properties based on design requirements. Producing a steel with a designed property is common. Producing a steel with more than one property becomes more difficult because enhancing one property may diminish or reduce the ability to achieve a second property. Oftentimes, the ability to produce or enhance one property in steel may be inversely proportional to producing or enhancing another desired property.

SUMMARY OF THE INVENTION

A method is used to fabricate a hot-rolled steel having a yield strength greater than 550 MPa and an impact toughness of at least 27 J. The method includes melting steel to create melted steel. The melted steel is poured into a mold. The metal steel is continuously cast into a steel slab. The steel slab is heated to maintain a predetermined temperature. The steel slab is rolled to reduce the thickness to a predetermined thickness to create a hot-rolled steel sheet.

BRIEF DESCRIPTION OF THE DRAWINGS

Advantages of the invention will be readily appreciated as the same becomes better understood by reference to the following detailed description when considered in connection with the accompanying drawings, wherein.

DETAILED DESCRIPTION OF THE PREFERRED EMBODIMENT

Figure 1:
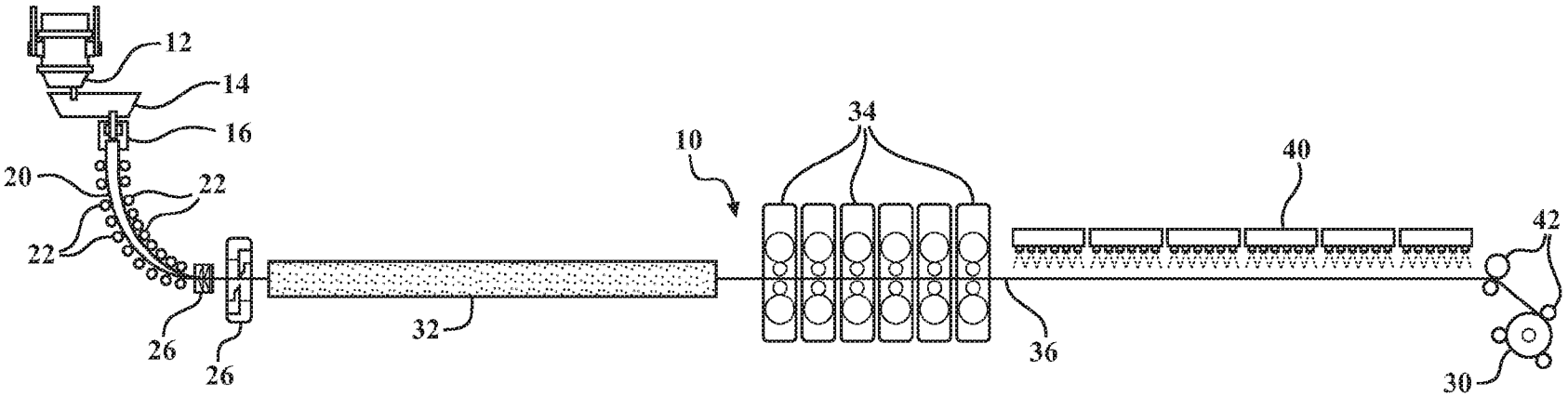
FIG. 1 is a schematic view of a mill line operating according to the method.

Referring to FIG. 1, one embodiment of a mill line is generally indicated at 10. From the perspective when viewing FIG. 1, the mill line 10 begins on the left side and finishes on the right side. The mill line 10 begins with a ladle 12 where steel (not shown) is melted at a temperature within the range of 40° F. to 70° F. above liquidus temperature. At the appropriate time, the melted steel (not shown) is poured into a tundish 14, where the melted steel is collected.

The composition of the steel includes the following composition by weight percentage; 0.045% < carbon < 0.06%, 1.20% < manganese < 1.50%, 0.02% < aluminum < 0.04%, 0.09% < titanium < 0.15%, 0.035% < niobium < 0.06%, 0.00% < chromium < 0.25%, with the balance being iron and impurities inherent in processing.

The melted steel then is poured through a mold 16. The mold 16 casts the melted steel to create cast steel 20 as it exits the mold 16. The cast steel 20 enters a segment section 22. The segment section 22 includes water cooled lines to cool the cast steel 20 from the outside in. This forms a case around the molten steel 20 and allows the molten steel 20 to continue to move through the mill line 10. The cooling of the cast steel 20 by the segment section 22 reduces the temperature to within a range of 1950° F. - 1650° F.

A sheer station 26 cut the cast steel 20 based on downstream activity: namely, upon the determination that enough cast steel 20 has passed the sheering station 26 to produce a complete roll of steel 30. At this stage in the mill line 10, the cast steel 20 is in range of 55 mm and 85 mm thick.

A furnace 32 maintains the temperature of the cast steel 20 to within a range of 2050° F. - 2100° F. for a period within a range of 15 minutes to 35 minutes as the cast steel 20 passes therethrough. Finishing mill stands 34 hot roll the cast steel 20 into a hot-rolled steel 36. The hot-rolled steel 36 is rolled out to a thickness less than 20 mm. More preferably, the thickness is in the range of 3 mm and 15 mm, inclusive.

A laminar cooling structure 40 cools the hot-rolled steel 36 before it is coiled by the coiling station 42. The laminar cooling structure 40 cools the temperature of the hot-rolled steel 36 to within a range of 1100° F. - 1225° F. for a period within a range of approximately six seconds to 15 seconds.

Figure 2:
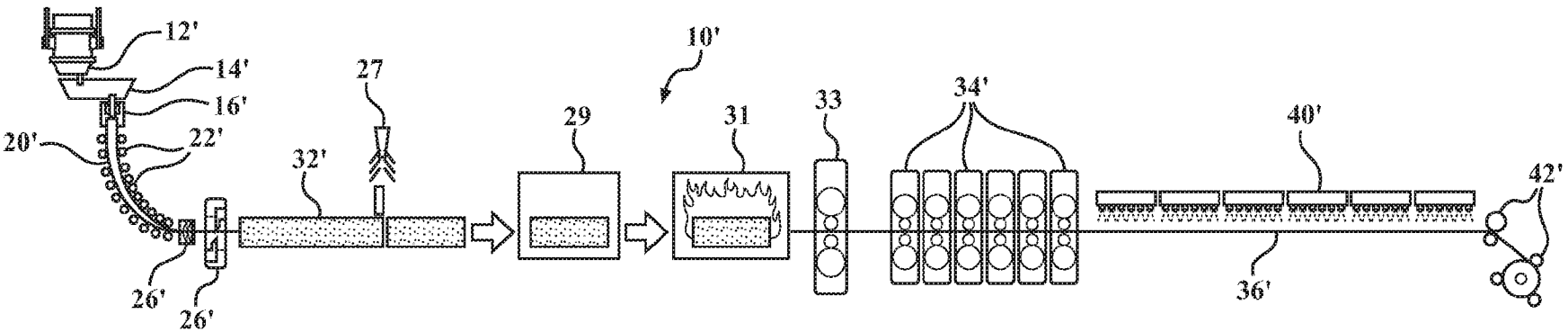
FIG. 2 PRIOR ART
FIG. 2 is a schematic view of a mill line operating according to the prior art.

Referring to FIG. 2, wherein like prime numerals represent similar elements as those described in FIG. 1, a prior art mill line 10′ is shown. It is similar to the mill line 10 of FIG. 1, but it includes additional elements. The first additional element is a slab cutting station 27, which cuts the cast steel 20′ at predetermined lengths for storage. When stored, the cast steel segments 29 are stored at room temperature.

Once retrieved from storage, the cast steel segments 29 are heated a second time in a second furnace 31. This second heating of the cast steel segments 29 allows the thickness of the cast steel segments 29 to be reduced by a rougher 33. The rougher 33 reduces the thickness of the cast steel segments 29 to approximately 35 mm - 45 mm. Once the cast steel segments 29 pass through the rougher 33, they are hot-rolled by the finishing mill stands 34′ into hot-rolled steel 36′ and coiled by the coiling station 42′.

By using the processing route set forth by the mill line 10 of FIG. 1, a slab cutting station 27, a second furnace (31 of FIG. 2) and a rougher (33 of FIG. 2) are not needed. This provides the distinct advantage of reducing the stations required to create a coil of hot-rolled steel, which translates directly into a smaller footprint for the mill line 10 as well as reduced energy consumption in producing the same coil of hot-rolled steel. An added advantage to the processing route of the mill line 10 is that there is one less level of inventory of material needed than with the prior art. This is because an inventory of the cast steel slabs 29 is not needed.

Figure 3:
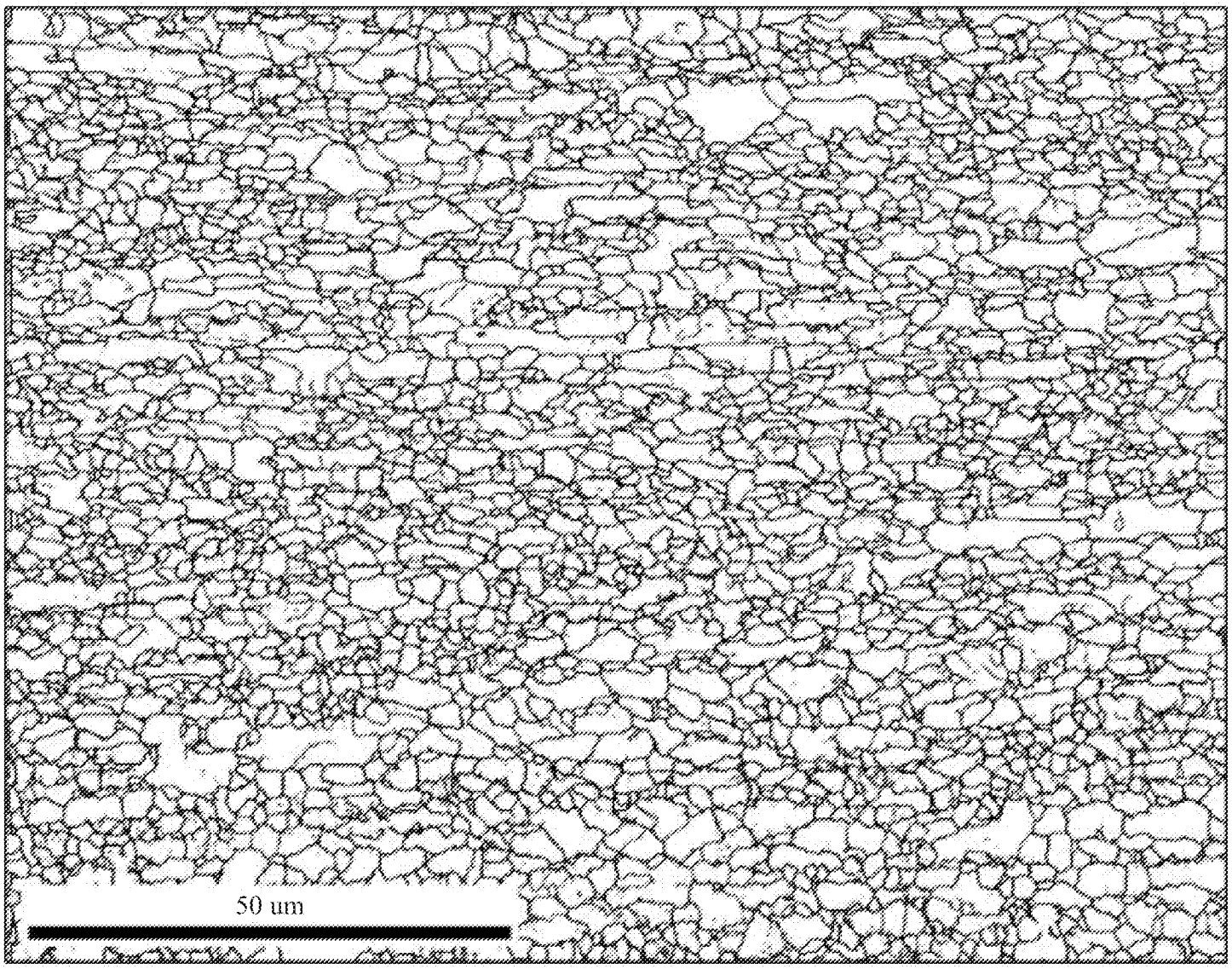
FIG. 3 is a graphic view of the grain structure of the steel produced using the method.

Returning attention to the hot-rolled steel 36 that results in the steel roll 30, the composition of steel as set forth above, in combination of with the temperature ranges and time ranges set forth above, results in a very fine ferrite grain size of approximately two to five microns as is shown in FIG. 3. Such a consistent ferrite grain size throughout the hot-rolled steel 36 is a desired characteristic because it guarantees ultra-high strength (ultra-high strength is any yield strength greater than 80 ksi or 550 MPa) and high impact toughness.

Figure 4:
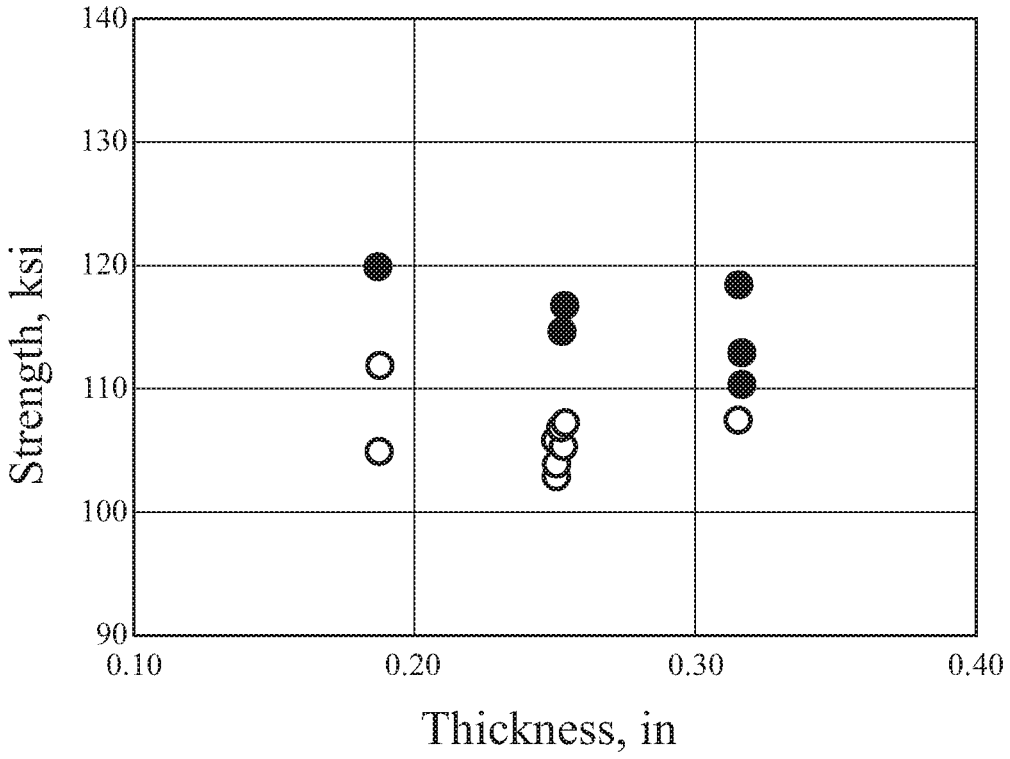
FIG. 4 is a graph of various yield strengths and tensile strengths of steel produced using the method as a function of steel thickness.

Referring to FIG. 4, the strength of the hot-rolled steel 36 as a function of thickness is shown. The yield strength data points are the hollow circles, whereas the tensile strength data points are the filled-in circles. For example, it can be seen that with a thickness of approximately 0.2 inches (approximately 5.08 mm), the yield strength is approximately 110 ksi (758 MPa) and the tensile strength is approximately 120 ksi (827 MPa).

Figure 5:
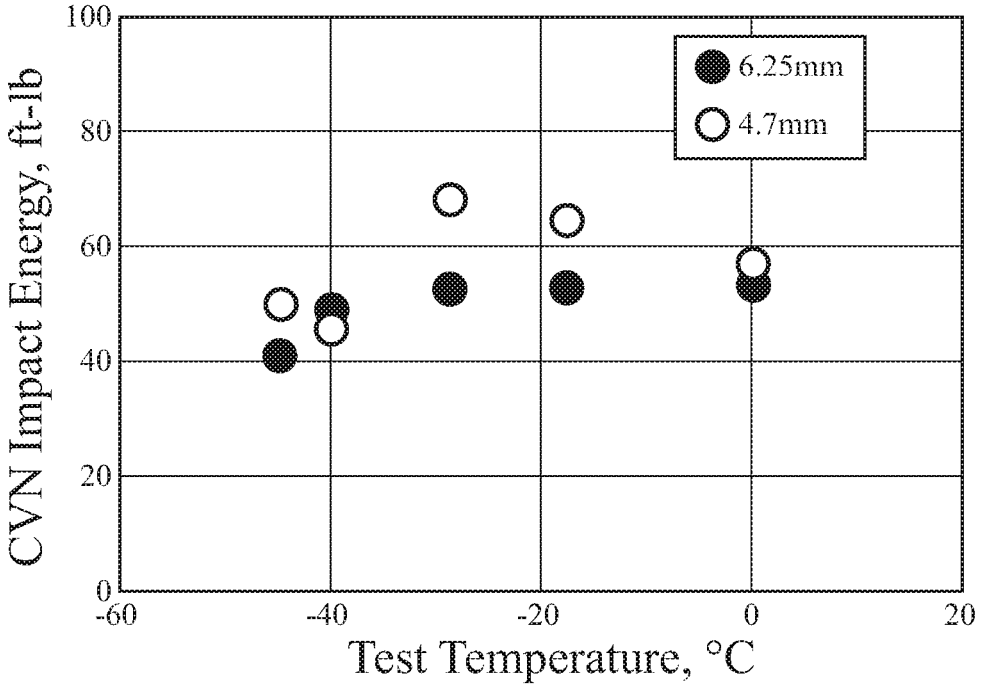
FIG. 5 is a graph of various tests impact toughness measurements of steel produced using the method as a function of temperature.

Referring to FIG. 5, data points represent the toughness of the hot-rolled steel 36 at low temperatures. In FIG. 5, the solid circles represent data points of a hot-rolled steel 36 having a thickness of 4.7 mm and the hollow circles represent data points of a hot-rolled steel 36 having a thickness of 6.25 mm.

By eliminating the steps of cooling the steel slab and reheating it, the composition of the steel set forth above be processed using the method illustrated in FIG. 1 manifests higher elongation, toughness and formability and very low in carbon equivalence (lower carbon dioxide emission during processing), which makes this steel easily cold formable and weldable. These are unexpected results that are highly desireable. In addition, the elimination of the thermomechanical rolling (using the rougher 33 of FIG. 2) makes the processing of the hot-rolled steel 36 is easier and faster than the method of the prior art.

The method and steel has been described in an illustrative manner. It is to be understood that the terminology, which has been used, is intended to be in the nature of words of description rather than of limitation.

Many modifications and variations of these descriptions are possible in light of the above teachings. Therefore, within the scope of the appended claims, the invention may be practiced other than as specifically described.

We claim:

1. A hot-rolled steel sheet comprises the following composition by weight percentage:

0.045% < carbon < 0.06%, 1.20% < manganese < 1.50%, 0.02% < aluminum < 0.04%, 0.09% < titanium < 0.15%, 0.035% < niobium < 0.06%, 0.00% < chromium < 0.25%, with the balance being iron and unavoidable impurities; and the hot-rolled steel sheet has an ultra-high yield strength greater than or equal to 710 MPa and an impact toughness of at least 27 J at a temperature of -40° F.

* * * * *